United States Patent [19]

Sarin et al.

[11] 4,427,082

[45] Jan. 24, 1984

[54] MINING DRILL

[75] Inventors: Vinod K. Sarin, Lexington; Peter Oberhauser, Sudbury, both of Mass.

[73] Assignee: GTE Laboratories, Inc., Waltham, Mass.

[21] Appl. No.: 346,970

[22] Filed: Feb. 8, 1982

[51] Int. Cl.[3] ..... E21B 10/62

[52] U.S. Cl. ..... 175/413; 175/410; 403/348

[58] Field of Search ..... 175/413, 410, 393, 320; 403/348, 339, 349

[56] References Cited

U.S. PATENT DOCUMENTS

| | | | |
|---|---|---|---|
| 1,130,726 | 3/1915 | Greve | 403/348 |
| 1,171,380 | 2/1916 | Arthur | 403/349 X |
| 3,032,129 | 5/1962 | Fletcher et al. | 175/410 |
| 3,434,552 | 3/1969 | Bower, Jr. | 175/410 |
| 4,165,790 | 8/1979 | Emmerich | 175/410 |

*Primary Examiner*—Stephen J. Novosad
*Assistant Examiner*—Thuy M. Bui
*Attorney, Agent, or Firm*—Robert E. Walter

[57] ABSTRACT

In a mine tool of the type having a drive body holding a bit, the bit and drive body include complimentary and mating surfaces wherein one pair of surfaces are adapted to be in overlapping relationship when the bit is twisted in a direction opposite the rotational direction for detachably mounting the bit to the drive body.

2 Claims, 9 Drawing Figures

MINING DRILL

FIELD OF INVENTION

The present invention relates to a mining drill which is particularily useful for drilling coal mine roof bolt holes.

BACKGROUND OF INVENTION

Roof drills are used for drilling holes in rock in the roof of mines for installing roof bolts. The drills are typically in the form of a drive body having a bit at the forward end with a hard wear-resistant material, such as tungsten carbide rigidly secured to the bit.

U.S. Pat. No. 4,190,128 to Emmerich relates to a roof drill having openings in the bit which connect to a hole in the drive body for the passage of air and removal of detritus.

U.S. Pat. No. 3,032,129 to Fletcher et al relates to a drill bit wherein the air is drawn into the drive body through open portions on each side of the bit.

U.S. Pat. No. 3,434,552 to Bower, Jr. relates to a bit having a slot with a cutting insert loosely held within the slot for free endwise sliding movement relative to the slot.

SUMMARY OF INVENTION

During drilling it is desirable to remove detritus, which is comprised of dust, cuttings and bit fragments generated during drilling due to the drilling action of the cutting insert. Inadequate removal results in an increase in the torque required to rotate the mining drill. Suction is typically applied through a passage in the drive body so that detritus can be removed from the hole being drilled.

In accordance with the present invention, there is provided a mine drill for aiding collection of detritus during drilling comprising a drive body being cylindrically shaped about an axis of rotation and having an axial passage for the flow of detritus, a bit mounted at the forward end of said drive body and adapted for being forwardly driven and rotated about said axis of rotation in a given direction during drilling, said bit comprising a body portion having a pair of support lands projecting therefrom in the axial direction and an elongated insert, said insert having forwardly projecting cutting edges, a base surface and side surfaces normal to said base surface extending toward said cutting edges, said base surface lying in a plane substantially normal to the axis of rotation and being secured to said body portion, each support land being offset said axis of rotation and secured to respective opposite sides of said insert whereby during rotation of said bit leading side surfaces are substantially unobstructed and trailing insert surfaces are mounted to respective support lands, said insert having end portions extending in a radial direction outwardly of said base portion and said drive body, said bit and said drive body including a plurality of mating and complimentary surfaces, a first mating surface for transmitting driving forces from said drive body to said bit, second mating surfaces for transmitting torsional forces of said drive body to said bit, and third mating surfaces adapted to be in overlapping relationship when said bit is twisted in a direction opposite to the given direction for detachably mounting said bit to said drive body and preventing forward separating movement of said bit from said drive body, a pair of air passages adapted for conveyance of detritus during drilling to said axial passage, each passageway being formed on an opposite side of said bit.

Also, in accordance with the present invention, there is provided a bit for detachably mounting to a drive body wherein said bit includes mating surfaces adapted to be in overlapping relationship with complimentary surfaces on the drive body when the bit is twisted in a given direction for preventing forward separating movement of the bit from the drive body.

DRAWINGS

In the drawings

DETAILED DESCRIPTION

Figure 1:
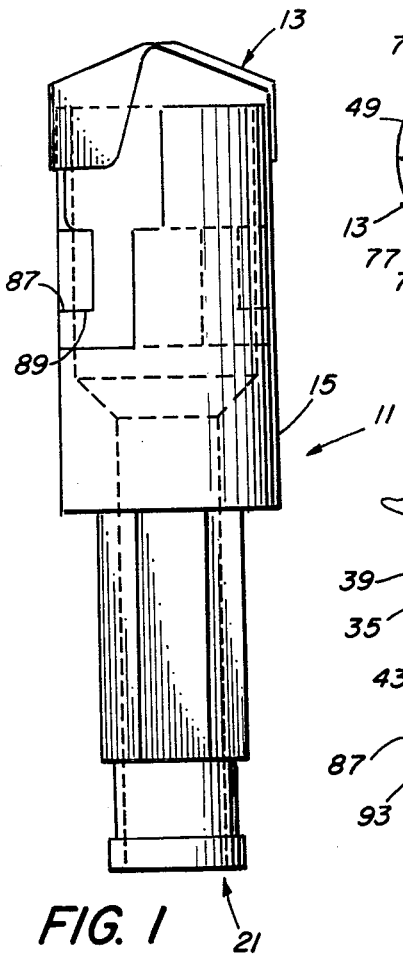
FIG. 1 is a side elevational view of the drill including bit mounted on the drive body.

FIG. 1 generally illustrates a mining drill 11 comprising a bit 13 mounted on a drive body 15 having an axial passage 17 for the flow of detritus from the cutting area. The drive body 15, is cylindrically shaped and capable of being mounted for movement about an axis of rotation 19. As illustrated in FIG. 1, the rearward end 21 has a hexagonal shape of reduced dimension forming a socket end which can be attached to another drive body having an air passage with a mating hexagonal recess. Multiple drive bodies can be conveniently connected to a drilling machine and vacuum source of a conventional type.

The terms forward and rearward are used for convenience of description and should not be taken as limiting the scope of the invention. For purposes of this description, forward generally refers to axial direction in which the drill is advanced during cutting and rearward is the opposite direction.

A bit 13 which is attached to the forward end 23 of the drive body includes an insert 25 rigidly attached thereto for movement about the axis of rotation 19. The insert 25 has forwardly projecting lands 27 which form an angle of from about 135° to about 145° and a rectangular base surface 29. Side surfaces 31 extend toward the forward lands 27 intermediate the end portions 35 of the insert 25. The forward lands 27 meet substantially at the axis of rotation 19 and slope downwardly from the cutting edges 33 in opposite directions either side of the point 53 at an angle of about 8° to about 12°. The cutting edges 33 are located above the two diagonally opposite corners of the rectangular base surface 29.

During rotation of the insert 25 during cutting, the cutting edges 33 lead the insert 25 so as to make primary cutting contact with the work, i.e. roof rock. For purposes of this description leading surfaces or edges are intended to refer to edges or surfaces which are first presented to the work in the direction of rotation.

The body portion 37 of the bit 13 includes a slot 39 which extends diametrically across the body portion 37 so as to form flat support surface 43 normal to the axis of rotation 19 of the bit 13. The body portion 37 further includes a pair of support lands 45 which project forwardly of the flat surface 43 in the axial direction so as to form vertical surfaces 47 which are the respective inner surfaces of the slot 39. As illustrated in detail in the drawings, a pair of vertical surfaces 47 are positioned in diagonally opposite sides of the slot 39. Each of the respective support lands 45 is offset the axis of rotation 19 and secured to respective opposite side surfaces 31 of the insert 25 whereby during rotation of the bit 13, leading insert surfaces 49 are substantially unobstructed and trailing insert surfaces 51 are mounted to respective support lands 45. The body portion 37 of the bit 13 may be conveniently formed by forging or precision casting and the slot 39 subsequently milled.

The insert 25 is mounted to the base portion 41 so that end portions 35 extend through the slot 39 in a radial direction outwardly of the body portion 37 and the drive body 15. Preferably the point 53 of the insert 25 is axially aligned with the axis of rotation 19 and the insert 25 is fixedly held in position in the slot 39 with the base surface 29 secured to the flat surface 43 and respective side surfaces 31 secured to respective vertical surfaces 47. Typically the securing is by brazing. The radial projection of the end portions 35 beyond the support lands 45 and the drive body 15 creates a hole slightly larger than the dimensions of the drive body 15. The radial outer dimensions of the lands 45 preferably match the outer dimensions of the drive body 15. Thus, during drilling, air is supplied or drawn into the drill hole by suction along the exterior of the drive body 15.

Figure 2:
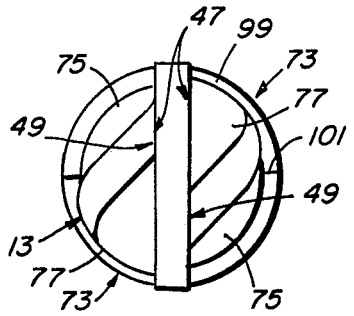
FIG. 2 is an end elevational view of the drill of FIG. 1.
Figure 3:
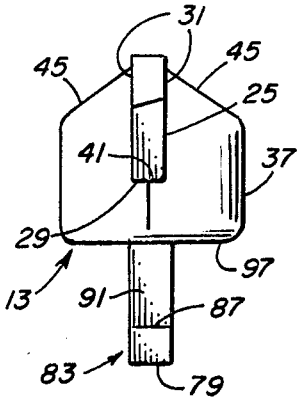
FIG. 3 is an end view of the bit.
Figure 4:
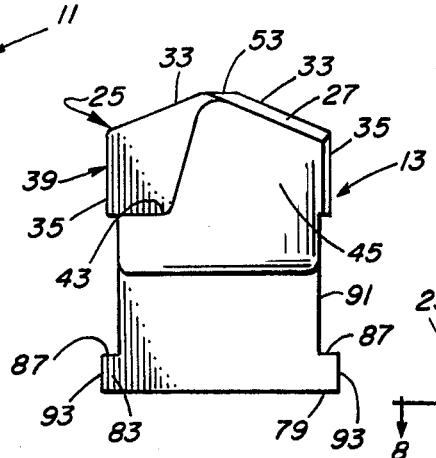
FIG. 4 is a side view of the bit of FIG. 3.
Figure 5:
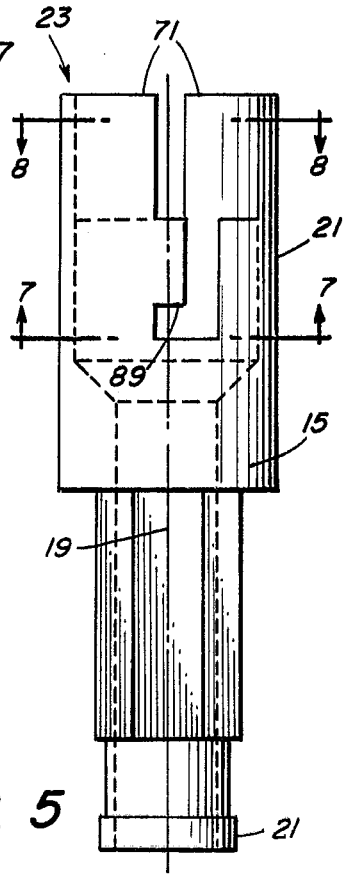
FIG. 5 is a side view of the drive body.
Figure 7:
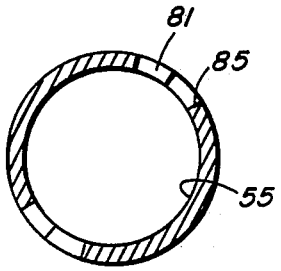
FIG. 7 is a sectional view along section 7—7 of FIG. 5.
Figure 6:
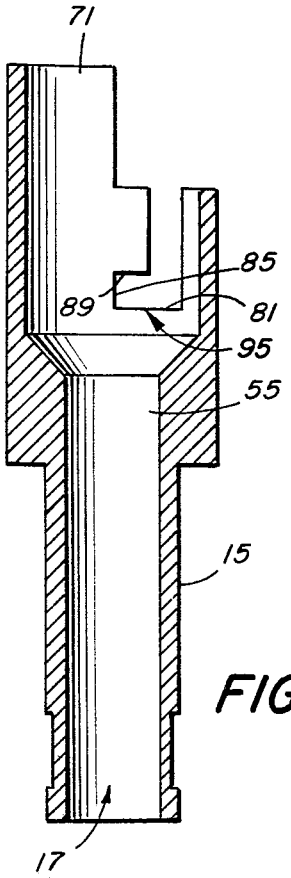
FIG. 6 is a sectional view of the drive body.
Figure 8:
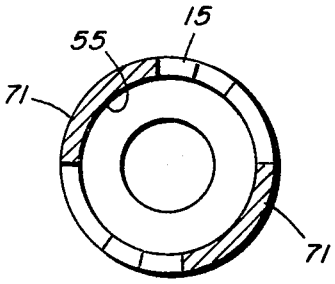
FIG. 8 is a sectional view of the drive body along section 8—8 of FIG. 5.
Figure 9:
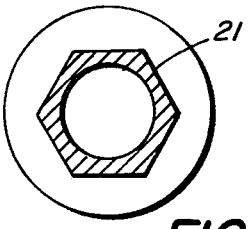
FIG. 9 is a rear elevational view of the drive body.

The drive body 15 includes a pair of forwardly projecting flanges 71 forming diametrically opposed apertures 73. Each of the apertures 73 is adapted to receive one of the respective end portions 35. The flanges 71 which are diametrically opposed extend in a direction forward of the plane of the base surface 29 of the insert 25 when the bit 13 is mounted to the drive body 15. Each of the flanges 71 is spaced from a respective side surface 31 so as to form a respective air passage 75 adapted for the conveyance of detritus during drilling to the axial passage 17. As illustrated in FIG. 2, each of the aperatures 73 are sufficiently large along the circumferential direction to accomodate the portion of respective support lands 45 which project in the radial direction beyond the inner surface 55.

As illustrated in the drawings, the flanges 71 are preferably an extension of the tubular shape of the drive body 15 formed by the concentric inner surface 55 and outer cylindrical shape. The flanges 71 have a forward end in a plane normal to the axis of rotation. Each of the flanges 71 extend forwardly to a position intermediate to the insert base surface 29 and the most rearward position of the cutting edges 33. From a side view of the insert 25, the most rearward position of the cutting edges 33 is along a plane passing through the most rearward portions of each of the cutting edges 33. Preferably the upper surface of the flange which corresponds to the forward end 21 is forwardly closer to the most rearward portion of the cutting edges 33 than midway the plane of the base surface 29 and the plane of the cutting edges 33. The air passages 75 are thusly positioned closely adjacent the cutting edges 33 of the bit 13 so that air sucked in adjacent the exterior of the drive body 15 preferably reverses direction, increases velocity and forces detritus through the air passages 75.

In the area adjacent the cutting edges 33, the respective air passages 75 which are in diametrically opposed quadrants are formed by respective unobstructed leading insert surfaces 49, the interior surface of the respective flanges 71, and the outer surface 77 of the respective support lands 45. Each of the respective support lands 45 which are in diametrically opposed quadrants have outwardly facing surfaces 77 that are within the confines of the drive body 15. Preferably each of the support lands 45 extend along the face of the insert 25 from an area spaced from the end of the insert 25 to about the midpoint of the insert 25.

In accordance with the principles of the present invention, there is provided a plurality of mating and complimentary surfaces, a first mating and complimentary surfaces 79, 81, for transmitting forward drilling driving forces from the drive body 15 to the bit 13, second mating surfaces 83, 85 for transmitting torque or rotational forces from the drive body 15 to the bit 13, and third mating surfaces 87, 89 in overlapping relationship when the bit 13 is twisted in a direction opposite to the given direction for detachably mounting the bit 13 to the drive body 15 and preventing forward separating movement of the bit 13 from the drive body 15.

As illustrated in detail in the drawings, one of a pair of first mating surfaces 79, 81 are shown as the bottom surface 79 of the shank 91. The shank 91 projects downwardly from the body portion 37 and includes tab portions 93 which project radially so as to overlap the surface 81 which is formed as a lower surface 81 of notched portion 95. The notched portion 95 is formed as a circumferential slot in the drive body 15 which communicates with an axial aligned slot permitting insertion and withdrawal of the bit 13. It is contemplated the first mating surfaces 79, 81 may be or include additional mating surfaces. Such additional surfaces may include lower surface 97 of the bit 13 and end surface 99 as shown in FIG. 2. In this case, the forward force due to drilling is transmitted to the lower surface 97 from end surface 99.

The second mating surfaces 83, 85 are illustrated as the side surface 83 of the tab portion 93 and the end surface 85 of the notched portion 95. It is contemplated that additional second mating surfaces may include end flange surface 101 which may engage the outer surface 77 of a respected support land 45. It is contemplated that the second mating surfaces 83, 85 may consist of the aforementioned latter surfaces.

In this latter case, the torque from the drive body 15 is transmitted to the bit 13 by engagement of one of the respective flanges 71 with one of the respective outer surfaces 77 of the support lands 45. In this case, the trailing land extends forwardly so that sufficient surface is in engagement to transmit the desired torque.

The third mating surfaces 87, 89 are illustrated in detail as the upper surface 87 of tab portion 93 and the upper surface 89 of the notch portion 95. It is contemplated that the complimentary and mating surfaces may instead include a notch in the shank 91 which mates with a projection on the inner surface 55 of the drive body 15. The above later described surfaces are adapted to be in overlapping relationship when the bit is twisted in a direction opposite to the given direction.

INDUSTRIAL APPLICABILITY

The mining drills are particularily useful for drilling coal mine roof bolt holes.

We claim:

1. A mine drill for aiding collection of detritus during drilling comprising a drive body being cylindrically shaped about an axis of rotation and having an axial passage for the flow of detritus, a bit mounted at the forward end of said drive body and adapted for being forwardly driven and rotated about said axis of rotation in a given direction during drilling, said bit comprising a body portion having a pair of support lands projecting therefrom in the axial direction and an elongated insert, said insert having forwardly projecting cutting edges, a base surface and side surfaces normal to said base surface extending toward said cutting edges, said base surface lying in a plane substantially normal to the axis of rotation and secured to respective opposite sides of said insert whereby during rotation of said bit leading side surfaces are substantially unobstructed and trailing insert surfaces are mounted to respective support lands, said insert having end portions extending in a radial direction outwardly of said base portion and said drive body, said bit and said drive body including a plurality of mating and complimentary surfaces, a first mating surface for transmitting driving forces from said drive body to said bit, second mating surfaces for transmitting torsional forces of said drive body to said bit, and third mating surfaces adapted to be in overlapping relationship when said bit is twisted in a direction opposite to the given direction for detachably mounting said bit to said drive body and preventing forward separating movement of said bit from said drive body, a pair of air passages adapted for conveyance of detritus during drilling to said axial passage, each passageway being formed on an opposite side of said bit.

2. A mine drill according to claim 1 wherein said drive body includes a pair of forwardly projecting flanges forming diametrically opposed aperture, each aperture receiving a respective end portion, each flange extending forwardly and spaced from respective opposite sides of said insert.

* * * * *